United States Patent [19]

Cheng

[11] Patent Number: 4,830,313

[45] Date of Patent: May 16, 1989

[54] KITE WITH IMPROVED STRUCTURE

[76] Inventor: Jun-Nan Cheng, No. 16, Lane 19, Fu Ho Road, Yung Ho City, Taipei, Taiwan

[21] Appl. No.: 206,083

[22] Filed: Jun. 13, 1988

[51] Int. Cl.[4] ..... B64C 31/06

[52] U.S. Cl. ..... 244/153 R; D21/88

[58] Field of Search ..... 244/153 R, 154, 155 R, 244/155 A; D21/88, 89

[56] References Cited

U.S. PATENT DOCUMENTS

| | | | |
|---|---|---|---|
| 1,734,493 | 11/1929 | Knoff | 244/153 R |
| 2,941,765 | 6/1960 | Feldmon | 244/153 R |
| 3,098,634 | 7/1963 | Finkler | 244/153 R |
| 4,076,189 | 2/1978 | Powell | 244/153 R |
| 4,103,850 | 8/1978 | Bushell | 244/153 R |
| 4,150,804 | 4/1979 | Jackson | 244/153 R |
| 4,426,800 | 1/1984 | Brown | 244/153 R |

OTHER PUBLICATIONS

*Kitelines,* p. 56, winter/spring, 1987.

*Primary Examiner*—Galen Barefoot

*Attorney, Agent, or Firm*—Lowe, Price, LeBlanc, Becker, & Shur

[57] ABSTRACT

A kite with improved structure, which is comprised of strip-like cylindrical body, wing set, retaining plate, balance rod, and support rod; the cylindrical body comprises an inclined cylindrical body having an inclined cylindrical hole at the terminal end to help flying-off; the cylindrical hole has a guide hole bilaterally to increase air-in and flying-off speed; the wing set is arranged to extend bilaterally over the cylindrical body and the balance rod is mounted on the wing set and fixed thereabout by means of the retaining plate such that the cylindrical body and the wing set are kept in good balance.

1 Claim, 2 Drawing Sheets

KITE WITH IMPROVED STRUCTURE

BACKGROUND OF THE INVENTION

Regular kites are made in plane configuration with the attachment of supporting frames on the bottom such that the flying of such kites is relied upon continuous air force and skillful driving technique. For young children, it is more than difficult to fly a lite and to control it, and thereby, the children may loose their insterest in flying a kite. Further, while a regular kite is to be collected for storage, the numerous support frames are difficult to manage, displacement of the frames may result in balance loosing of the kite and the kite maybe unable to fly or may drop suddenly after flying-off.

In view of the above described, the present inventor has created a kite with improved structure to make it more practical and to attract people and children's attention, of which the structure is composed of a strip-like cylindrical body and a wing set in an unitart piece such that the kite can be promptly flown-off by means of the design of cylindrical hole.

The present invention relates a kite with improved structure, which is composed of cylindrical body, wing set, support rod, retaining plate, and balance rod; by means of the design of cylindrical hole of the cylindrical body, the cylindrical hole will be immediately filled up with air while flying and help the kite be flown-off at a faster speed; by means of the arrangement to make the cylindrical body and the wing set be in an unitary piece, the kite can be flown-off with minimum air force and can be kept in good balance; by means of the arrangement of a guide hole, the kite can be easily and stably flown-off against unstable wind; by means of the said arrangement to improve the stortcomings of regular kites and by means of a solid structure to provide a better and more attractive appearance.

SUMMANY OF THE INVENTION

The present invention is to provide a kite with improved structure, which is comprised of strip-like cylindrical body, wing set, retaining plate, balance rod, and support rod; said cylindrical body comprises an inclined cylindrical hole at the terminal end to help flying-off; said cylindrical hole comprises a guide hole bilaterally to increase air-in and flying-off speed; said wing set is arranged to extend bilaterally over the cylindrical body and said balance rod is mounted on the wing set and fixed thereabout by means of said retaining plate such that the cylindrical body and the wing set are kept in good balance.

DETAILED DESCRIPTION OF THE PREFERRED EMBODIMENTS

Figure 1:
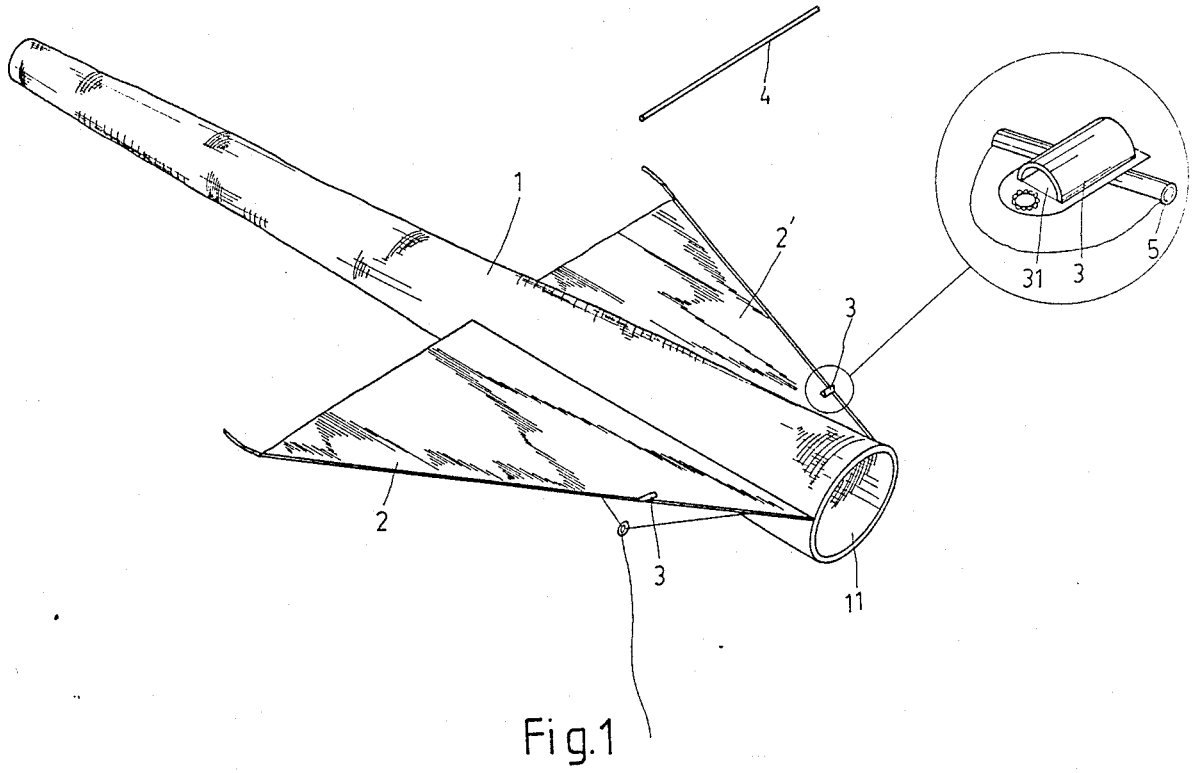
FIG. 1 is a fragmentary perspective view of a kite embodying the present invention.
Figure 2:
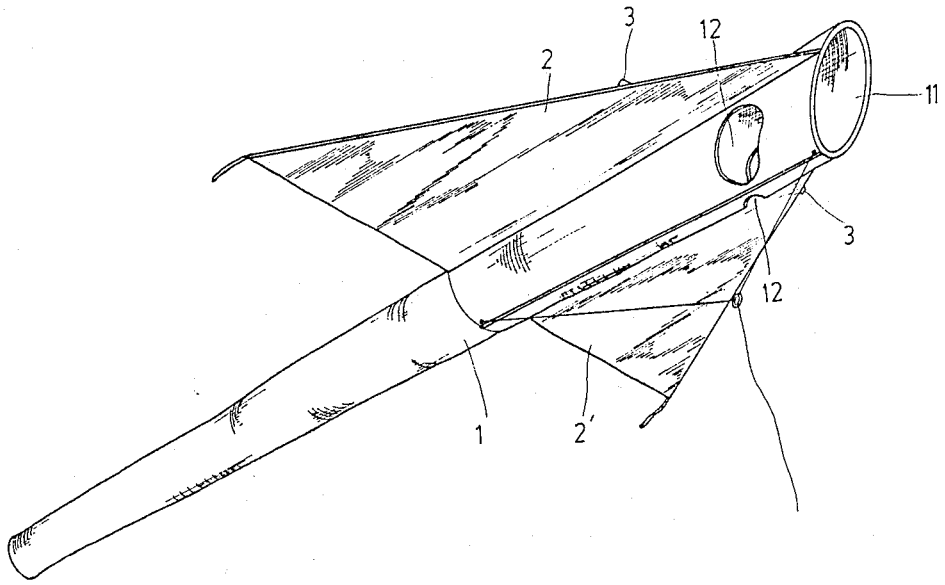
FIG. 2 illustrates the outer appearance of the preferred embodiment according to the present invention.

The kite, according to the present invention, is comprised of a strip-like cylindrical body 1, two wings 2 and 2', retaining plates 3, balance rod 4, and support rod 5. Said strip-like cylindrical body 1 comprises inside at the front end a circular support rod to support such that the cylindrical hole 11 of the cylindrical body at the front terminal end is arranged in inclined shape. Said cylindrical hole 11 has a largest diameter at the front and is gradually reducing to form a trapesoidal shape. By means of the trapesoidal configuration, the cylindrical hole can be easily filled up with air for quick flying-off. Said cylindrical hole 11 comprises bilaterally a guide hole 12 such that the flying-off speed of the kite can be accelerated and the kite can be kept in good balance while flying. Said wings 2 and 2' and the cylindrical body 11 are made in an unitary piece, and the wings are respectively arranged by each side of the cylindrical body 11, a support rod is inserted into the outer margin of each wing 2 and 2' such that the wings 2 and 2' can keep the cylindrical body in good balance while flying-off. Said retaining plate 3 that attached to each support rod 5 of the wings 2 and 2' comprises an inward retaining hole 31 for the connection of said balance rod 4. Said balance rod 4 is retained with both ends respectively in the retaining hole 31 of each retaining plate 3 that mounted bilaterally on the wings 2 and 2' so as to reinforce the balance of the kite.

According to the present invention, the cylindrical hole 11 is arranged in an inclined configuration to maximize the contact surface with the air while the wind is flowing therethrough, therefore, the kite can be more quickly flown-off.

The kite according to the present invention is made in an unitary piece to reinforce the stability and to help accelerating the flying-off speed.

The design of the guide hole 12 according to the present invention is arranged such that the wind can blow into the cylindrical body 1 either through the cylindrical hole 11 or the guide hole 12 to speed up a stable flying-off and to prevent sudden drop due to limitation of single air inlet while the wind is changing its direction.

What is claimed is:

1. A kite with improved structure, comprised of:

a strip-like cylindrical body, being supported by a circular support rod at the front to form an inclined cylindrical hole, said cylindrical hole being in a trapezoidal configuration for quick filling of air and comprising bilaterally a guide hole for stable flying-off of the kite during wind change;

a wing set being arranged bilaterally of the cylindrical body and being made with the cylindrical body into an unitary piece, each of said wing set being supported with a support rod along their respective leading edges and fixedly attached to a retaining plate;

said retaining plate attached to an intermediate portion of the support rod and having a retaining hole in the center;

a balance rod with both terminal ends respectively inserted into the retaining holes of two said retaining plates to provide the kite with a good balance.

* * * * *